US011790851B2

(12) United States Patent
Han

(10) Patent No.: US 11,790,851 B2
(45) Date of Patent: Oct. 17, 2023

(54) DISPLAY DEVICE AND GAMMA UNIT INCLUDING FIRST AND SECOND REFERENCE VOLTAGE GENERATORS FOR DISPLAY PANEL

(71) Applicant: LG Display Co., Ltd., Seoul (KR)

(72) Inventor: KwangHee Han, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/984,924

(22) Filed: Nov. 10, 2022

(65) Prior Publication Data

US 2023/0154408 A1 May 18, 2023

(30) Foreign Application Priority Data

Nov. 15, 2021 (KR) ..... 10-2021-0156600

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2320/0673* (2013.01)

(58) Field of Classification Search
None
See application file for complete search history.

(56) References Cited

U.S. PATENT DOCUMENTS

2015/0170609 A1* 6/2015 Jung ..... G09G 3/20 345/212
2016/0049113 A1* 2/2016 Park ..... G09G 3/3208 345/212
2016/0379558 A1* 12/2016 Jeon ..... G09G 3/3225 345/213
2020/0211457 A1* 7/2020 Kim ..... G09G 3/3233
2021/0256909 A1* 8/2021 Lee ..... G09G 3/3233
2021/0327350 A1* 10/2021 Nam ..... G09G 3/3233
2022/0223091 A1* 7/2022 Chae ..... G09G 3/3275

FOREIGN PATENT DOCUMENTS

KR 10-2016-0082877 A 7/2016
KR 10-2021-0017876 A 2/2021

* cited by examiner

*Primary Examiner* — Kirk W Hermann
(74) *Attorney, Agent, or Firm* — Birch, Stewart, Kolasch & Birch, LLP

(57) ABSTRACT

A display device including a display panel including a plurality of pixels; a gamma unit including a first gamma reference voltage generator configured to generate a first gamma reference voltage; a second gamma reference voltage generator configured to generate a second gamma reference voltage; a gamma voltage generator configured to output a first gamma voltage based on the first gamma reference voltage or output a second gamma voltage based on the second gamma reference voltage; and a voltage setting unit configured to selectively connect the first gamma reference voltage generator to the gamma voltage generator or selectively connect the second gamma reference voltage generator to the gamma voltage generator. Further, the second gamma reference voltage is coupled to a feedback voltage of the high potential power voltage from the display panel.

20 Claims, 9 Drawing Sheets

DISPLAY DEVICE AND GAMMA UNIT INCLUDING FIRST AND SECOND REFERENCE VOLTAGE GENERATORS FOR DISPLAY PANEL

CROSS-REFERENCE TO RELATED APPLICATION

This application claims the priority of Korean Patent Application No. 10-2021-0156600 filed on Nov. 15, 2021, in the Korean Intellectual Property Office, the disclosure of which is incorporated herein by reference.

BACKGROUND OF THE DISCLOSURE

Field

The present disclosure relates to a display device, and more particularly, to a display device which improves a display quality by changing a gamma reference voltage, and a gamma unit for a display panel.

Background Art

Display devices used for a computer monitor, a television, or a cellular phone include a self-emitting organic light emitting display device (OLED) and a liquid crystal display device (LCD) requiring a separate light source. The range of display devices is diversified and display devices are used in personal digital assistants, computer monitors and televisions. A display device with a large display area and a reduced volume and weight is also being studied.

Further, the display device divides a gamma reference voltage to generate a plurality of gamma voltages and generates a data voltage based on the divided gamma voltages. The characteristic of a displayed image also changes depending on the gamma reference voltage and the gamma voltages.

SUMMARY OF THE DISCLOSURE

Accordingly, one object of the present disclosure is to provide a display device which changes a gamma reference voltage to control a luminance.

Another of the present disclosure is to provide a display device which reduces screen flickering due to a sudden voltage variation when the gamma reference voltage varies.

Still another object of the present disclosure is to provide a display device which couples a gamma reference voltage and a high potential power voltage to minimize a luminance change according to a voltage drop.

In order to achieve the above-described objects, according to an aspect of the present disclosure, a display device includes a gamma unit including a gamma reference voltage generator which generates a plurality of gamma reference voltages and a gamma voltage generator which generates a gamma voltage based on the gamma reference voltages; a data driver which generates a data voltage based on the gamma voltage; and a display panel which is electrically connected to the data driver, the gamma reference voltage generator includes: a first gamma reference voltage generator which generates a first gamma reference voltage, among the plurality of gamma reference voltages, based on an external power; and a second gamma reference voltage generator which generates a second gamma reference voltage, among the plurality of gamma reference voltages, based on a feedback voltage of a high potential power voltage from the display panel. Accordingly, according to the present disclosure, a plurality of gamma reference voltages may vary according to the characteristic of the image to be used.

In order to achieve the above-described objects, according to another aspect of the present disclosure, a display device includes a gamma unit including a first gamma reference voltage generator which generates a first gamma reference voltage, a second gamma reference voltage generator which generates a second gamma reference voltage, and a gamma voltage generator which generates a gamma voltage based on the first gamma reference voltage and the second gamma reference voltage; a data driver which generates a data voltage based on the gamma voltage; and a display panel which includes a plurality of pixels which is driven by a high potential power voltage and the data voltage, when an on pixel ratio representing a ratio of turned on pixels among the plurality of pixels is lower than a reference pixel ratio, the gamma reference voltage generator generates the gamma voltage based on the first gamma reference voltage and when the on pixel ratio is higher than the reference pixel ratio, the gamma voltage generator generates the gamma voltage based on the second gamma reference voltage. As a result, according to the present disclosure, a first gamma reference voltage is used for a relatively dark image having a low on pixel ratio to increase a contrast of black and white. Further, a second gamma reference voltage is used for a relatively bright image having a high on pixel ratio so that the luminance degradation due to the variation of the high potential power voltage may be minimized.

In order to achieve the above-described objects, according to yet another aspect of the present disclosure, a gamma unit for a display panel comprises: a gamma reference voltage generator which generates a plurality of gamma reference voltages; and a gamma voltage generator which generates a gamma voltage based on the gamma reference voltages, wherein the gamma reference voltage generator includes: a first gamma reference voltage generator which generates a first gamma reference voltage, among the plurality of gamma reference voltages, based on an external power; and a second gamma reference voltage generator which generates a second gamma reference voltage, among the plurality of gamma reference voltages, based on a feedback voltage of a high potential power voltage from the display panel.

According to the present disclosure, a gamma reference voltage can vary depending on a characteristic of an image to be displayed, and the luminance variation due to the voltage drop of the high potential power voltage in an image having a high on pixel ratio can be minimized.

Further, the luminance increase in an image having a low on pixel ratio is maximized to improve a contrast ratio, and the gamma reference voltage gradually varies to reduce the screen flickering.

Further scope of applicability of the present invention will become apparent from the detailed description given hereinafter. However, the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
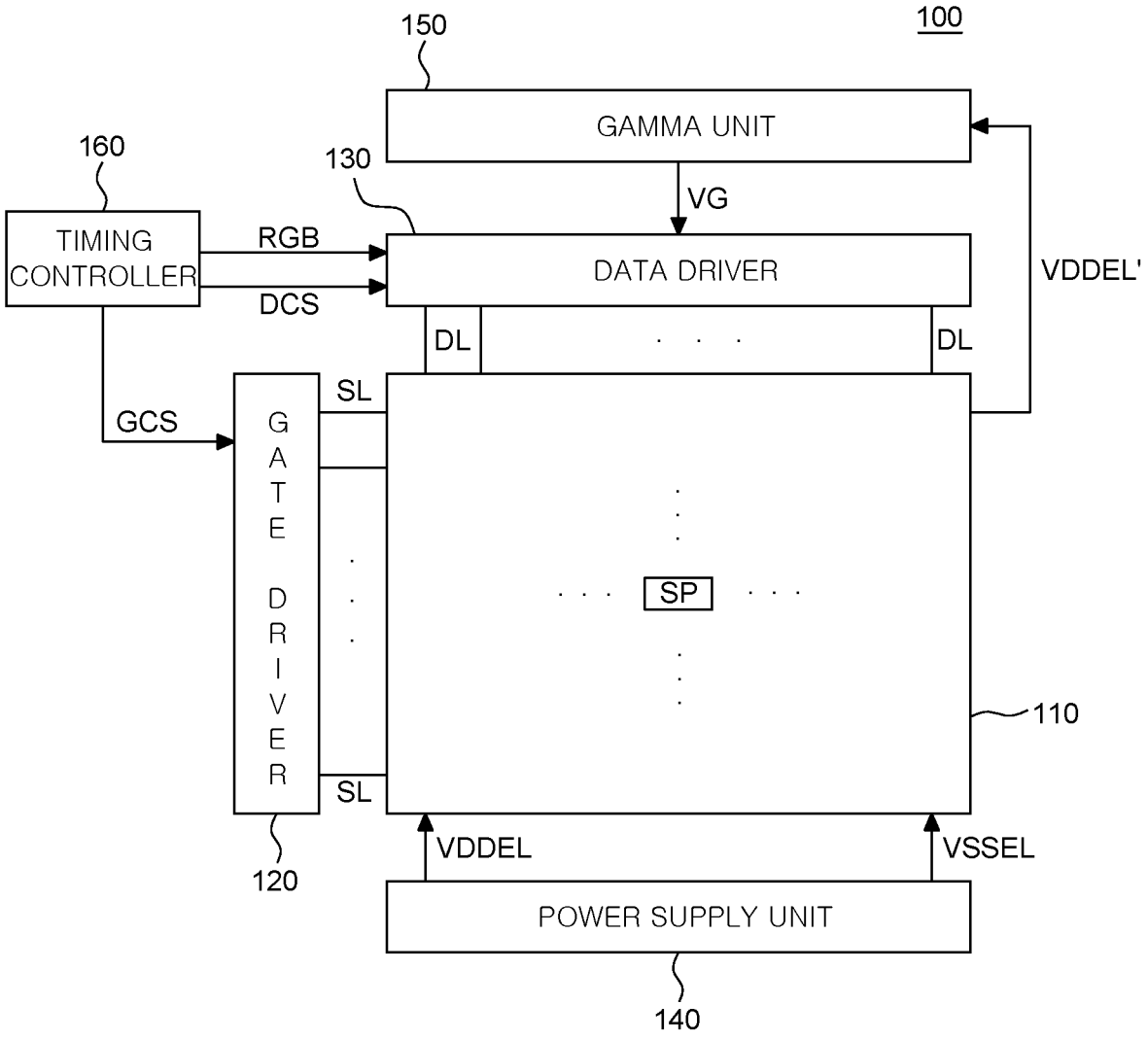
FIG. 1 is a schematic diagram of a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated. When the position relation between two parts is described using the terms such as "on", "above", "below", and "next", one or more parts may be positioned between the two parts unless the terms are used with the term "immediately" or "directly". When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure. Like reference numerals generally denote like elements throughout the specification.

A size and a thickness of each component illustrated in the drawing are illustrated for convenience of description, and the present disclosure is not limited to the size and the thickness of the component illustrated. The features of various embodiments of the present disclosure can be partially or entirely adhered to or combined with each other and can be interlocked and operated in technically various ways, and the embodiments can be carried out independently of or in association with each other.

Hereinafter, a display device according to exemplary embodiments of the present disclosure will be described in detail with reference to accompanying drawings.

FIG. 1 is a schematic diagram of a display device according to an exemplary embodiment of the present disclosure. In particular, FIG. 1 illustrates, among various components of the display device 100, a display panel 110, a gate driver 120, a data driver 130, a gamma unit 150, a power supply unit 140, and a timing controller 160.

Referring to FIG. 1, the display device 100 includes a display panel 110 including a plurality of sub pixels SP, a gate driver 120 and a data driver 130 which supply various signals to the display panel 110, a gamma unit 150 which supplies a gamma voltage VG to the data driver 130, a timing controller 160 which controls the gate driver 120 and the data driver 130, and a power supply unit 140 which supplies various powers.

The gate driver 120 supplies scan signals to a plurality of scan lines SL in accordance with a plurality of gate control signals GCS supplied from the timing controller 160. Even though FIG. 1 illustrates one gate driver 120 is disposed to be spaced apart from one side of the display panel 110, the number of the gate drivers 120 and the placement thereof are not limited thereto.

Further, the data driver 130 converts image data RGB input from the timing controller 160 in accordance with a plurality of data control signals DCS supplied from the timing controller 160 into a data voltage Vdata using a gamma voltage VG. The data driver 130 receives the gamma voltage VG from the gamma unit 150 to select a gamma voltage VG corresponding to a gray scale of the image data RGB among received gamma voltages VG, to generate the data voltage Vdata, and can supply the generated data voltage Vdata to a plurality of data lines DL.

In addition, the power supply unit 140 generates a power to be applied to the data driver 130, the gamma unit 150, and the display panel 110. For example, the power supply unit 140 can supply a power for driving the gamma unit 150 and the data driver 130 and a high potential power voltage VDDEL and a low potential power voltage VSSEL for driving the display panel 110. Further, the power supply unit 140 can supply a power for driving the other elements of the display device 100.

In addition, the timing controller 160 aligns image data RGB input from the outside to supply the image data RGB to the data driver 130. In more detail, the timing controller 160 can generate a gate control signal GCS and a data control signal DCS using synchronization signals input from the outside, such as a dot clock signal, a data enable signal, and horizontal/vertical synchronization signals. The timing controller 160 supplies the gate control signal GCS and the data control signal DCS to the gate driver 120 and the data driver 130, respectively, to control the gate driver 120 and the data driver 130.

The display panel 110 displays images to the user and includes the plurality of sub pixels SP. In the display panel 110, the plurality of scan lines SL and the plurality of data lines DL intersect each other and the plurality of sub pixels SP are connected to the scan lines SL and the data lines DL, respectively. In addition, the high potential power voltage VDDEL and the low potential power voltage VSSEL are supplied to each sub pixel SP, which will be described below in more detail with reference to FIG. 2.

In addition, each sub pixel SP is a minimum display unit and several sub pixels SP are gathered to form one pixel. Each sub pixel SP includes a light emitting element and a pixel circuit for driving the light emitting element. The plurality of light emitting elements can be defined in different manners depending on the type of the display panel 110. For example, when the display panel 110 is an organic light emitting display panel, the light emitting element can be an organic light emitting diode including an anode, an organic light emitting layer, and a cathode. In addition, as the light emitting element, a light emitting diode (LED), or a quantum-dot light emitting diode (QLED) including quantum dots (QD) can be used.

Further, the gamma unit 150 generates a gamma reference voltage and divides the gamma reference voltage to generate a plurality of gamma voltages VG. The gamma unit 150 generates and supplies the gamma voltages VG to the data driver 130, and the data driver 130 generates the data voltage based on the supplied gamma voltages VG.

Further, the gamma unit 150 can generate a gamma reference voltage using a feedback voltage VDDEL' of the high potential power voltage VDDEL transmitted from the display panel 110 in a specific image. This will be described below with reference to FIGS. 3 to 7B.

Hereinafter, the plurality of sub pixels SP will be described in more detail with reference to FIG. 2. In particular, FIG. 2 is a circuit diagram of a sub pixel SP of a display device according to an exemplary embodiment of the present disclosure.

Figure 2:
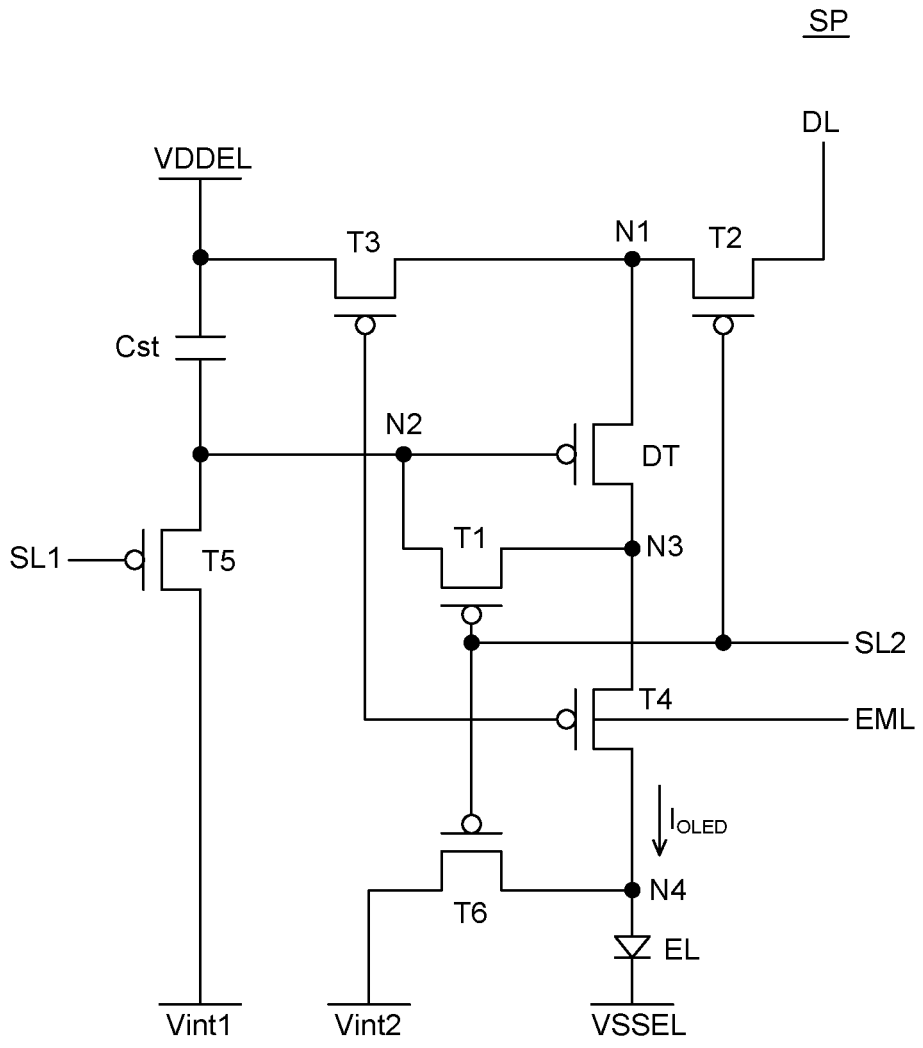
FIG. 2 is a circuit diagram of a sub pixel of a display device according to an exemplary embodiment of the present disclosure.

Referring to FIG. 2, each sub pixel SP is connected to a first scan line SL1, a second scan line SL2, a data line DL, an emission control signal line EML, a first initialization line, a second initialization line, a high potential power line, and a low potential power line. As shown, each sub pixel SP also includes a first transistor T1, a second transistor T2, a third transistor T3, a fourth transistor T4, a fifth transistor T5, a sixth transistor T6, a driving transistor DT, a storage capacitor Cst, and a light emitting element EL are disposed.

In addition, the driving transistor DT includes a gate electrode, a source electrode, and a drain electrode. As shown, the source electrode of the driving transistor DT is connected to a first node N1, the gate electrode is connected to a second node N2, and the drain electrode is connected to a third node N3. The driving transistor DT also controls a driving current $I_{oled}$ flowing in the light emitting element EL.

Further, the first transistor T1 includes a gate electrode, a source electrode, and a drain electrode. As shown, the gate electrode of the first transistor T1 is connected to a second scan line SL2, the source electrode is connected to the second node N2, and the drain electrode is connected to the third node N3. The first transistor T1 can also connect the gate electrode and the drain electrode of the driving transistor DT and cause the driving transistor DT to form a diode connection. In particular, in the diode connection, the gate electrode and the drain electrode are shorted so that the transistor operates as a diode.

In addition, second transistor T2 includes a gate electrode, a source electrode, and a drain electrode. As shown, the gate electrode of the second transistor T2 is connected to a second scan line SL2, the source electrode is connected to the data line DL, and the drain electrode is connected to the first node N1. The second transistor T2 can thus transmit a data voltage Vdata from the data line DL to the first node N1 based on a scan signal of the second scan line SL2.

Further, the third transistor T3 includes a gate electrode, a source electrode, and a drain electrode. As shown in FIG. 2, the gate electrode of the third transistor T3 is connected to the emission control signal line EML, the source electrode is connected to the high potential power line, and the drain electrode is connected to the first node N1. The third transistor T3 can thus transmit a high potential power voltage VDDEL to the first node N1 based on an emission control signal of the emission control signal line EML.

In addition, the fourth transistor T4 includes a gate electrode, a source electrode, and a drain electrode. As shown, the gate electrode of the fourth transistor T4 is connected to the emission control signal line EML, the source electrode is connected to the third node N3, and the drain electrode is connected to the fourth node N4. The fourth transistor T4 can thus transmit a driving current $I_{oled}$ from the driving transistor DT to the light emitting element EL based on the emission control signal of the emission control signal line EML.

Also, the fifth transistor T5 includes a gate electrode, a source electrode, and a drain electrode. As shown, the gate electrode of the fifth transistor T5 is connected to a first scan line SL1, the source electrode is connected to the first initialization line, and the drain electrode is connected to the second node N2. The fifth transistor T5 can thus reset the second node N2 with a first initialization voltage Vinit1 from the first initialization line, based on the scan signal of the first scan line SL1.

In addition, the sixth transistor T6 includes a gate electrode, a source electrode, and a drain electrode. As shown, the gate electrode of the sixth transistor T6 is connected to a second scan line SL2, the source electrode is connected to the second initialization line, and the drain electrode is connected to the fourth node N4. The sixth transistor T6 can thus reset the fourth node N4 with a second initialization voltage Vinit2 from the second initialization line, based on the scan signal of the second scan line SL2.

Further, the storage capacitor Cst includes a capacitor electrode connected to the high potential power line and a capacitor electrode connected to the second node N2. A data voltage Vdata, in which the threshold voltage of the driving transistor DT is compensated, is charged in the storage capacitor Cst to sample the data, and compensate for a deviation of each driving transistor DT of each sub pixel SP.

Further, the light emitting element EL also includes a first electrode and a second electrode. In particular, the first electrode of the light emitting element EL is connected to the fourth node N4 and the second electrode is connected to a low potential power voltage VSSEL. The light emitting element EL can thus emit light by a driving current $I_{oled}$ from the driving transistor DT.

$$I_{oled}=k/2*(VDDEL-V\text{data})^2 \quad \text{(Equation 1)}$$

Thus, the driving current $I_{oled}$ flowing in the light emitting element EL can be defined by Equation 1. Here, k is a constant value determined by a mobility and a parasitic capacitance of the driving transistor DT.

Referring to Equation 1, the driving current $I_{oled}$ is determined by the high potential power voltage VDDEL and the data voltage Vdata. Further, the data voltage Vdata can be generated based on the gamma voltage VG. In the display device 100 according to the exemplary embodiment of the present disclosure, the gamma voltage VG used for generating the data voltage Vdata is generated only by an external power, or the gamma voltage is coupled to the high potential power voltage VDDEL to control the luminance of the display device, depending on the image to be displayed. Accordingly, in the display device 100 according to the exemplary embodiment of the present disclosure, the luminance variation in accordance with the voltage drop of the high potential power voltage VDDEL can be minimized according to the characteristic of the image to be displayed. Further, the luminance increase is maximized to improve the contrast of the black and white, that is, a contrast ratio.

Hereinafter, the gamma unit 150 will be described in more detail with reference to FIGS. 3 to 7B. In particular, FIG. 3 is a diagram of the gamma unit 150 of a display device according to an exemplary embodiment of the present disclosure.

Figure 3:
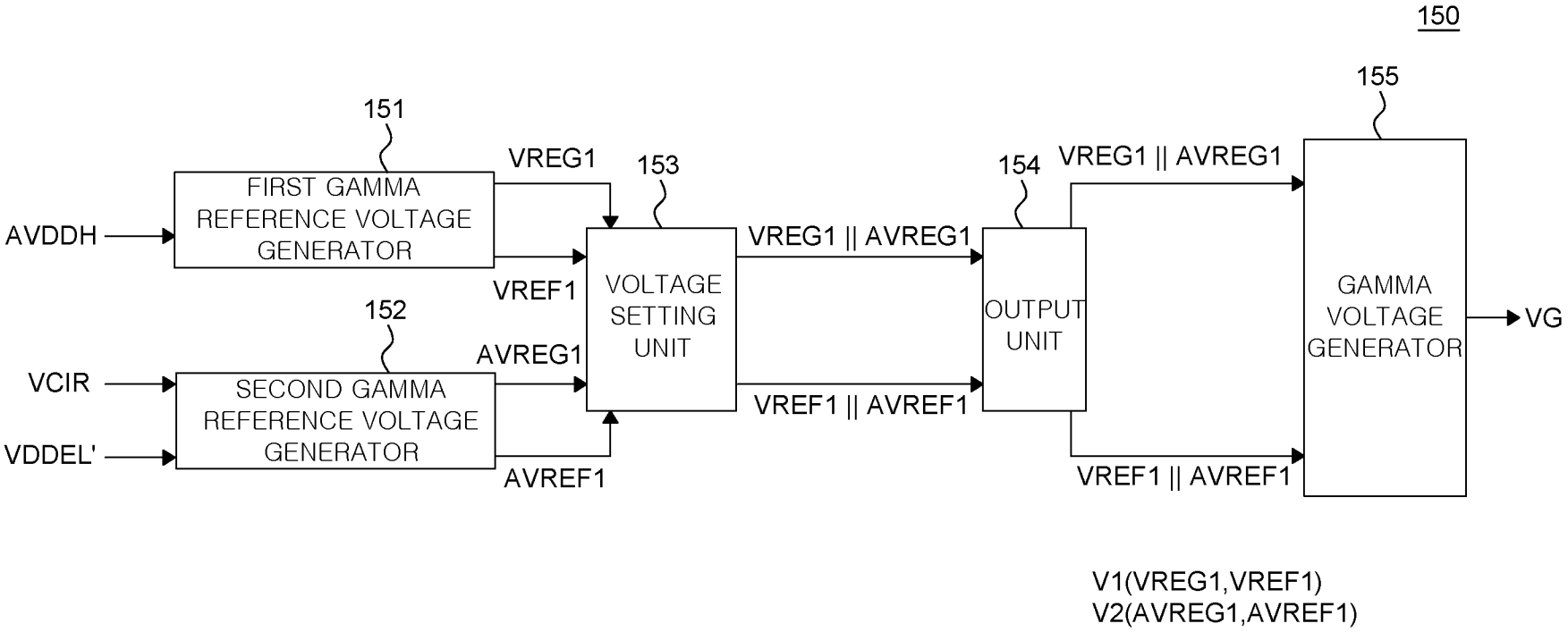
FIG. 3 is a diagram of a gamma unit of a display device according to an exemplary embodiment of the present disclosure.

Referring to FIG. 3, the gamma unit 150 includes a first gamma reference voltage generator 151, a second gamma reference voltage generator 152, a voltage setting unit 153, an output unit 154, and a gamma voltage generator 155. Referring to FIG. 3, the first gamma reference voltage generator 151 generates a first gamma reference voltage V1 based on a first external power AVDDH. As shown in FIG. 3, the first gamma reference voltage V1 includes a first upper gamma reference voltage VREG1 and a first lower gamma reference voltage VREF1. The first gamma reference voltage generator 151 generates the first gamma reference voltage V1 based on the first external power AVDDH so that the first gamma reference voltage V1 which has a constant value regardless of the voltage drop of the high potential power voltage VDDEL may be generated. For example, even though an amount of changed feedback voltage VDDEL' is increased, the first gamma reference voltage V1 may be constantly maintained.

Figure 4:
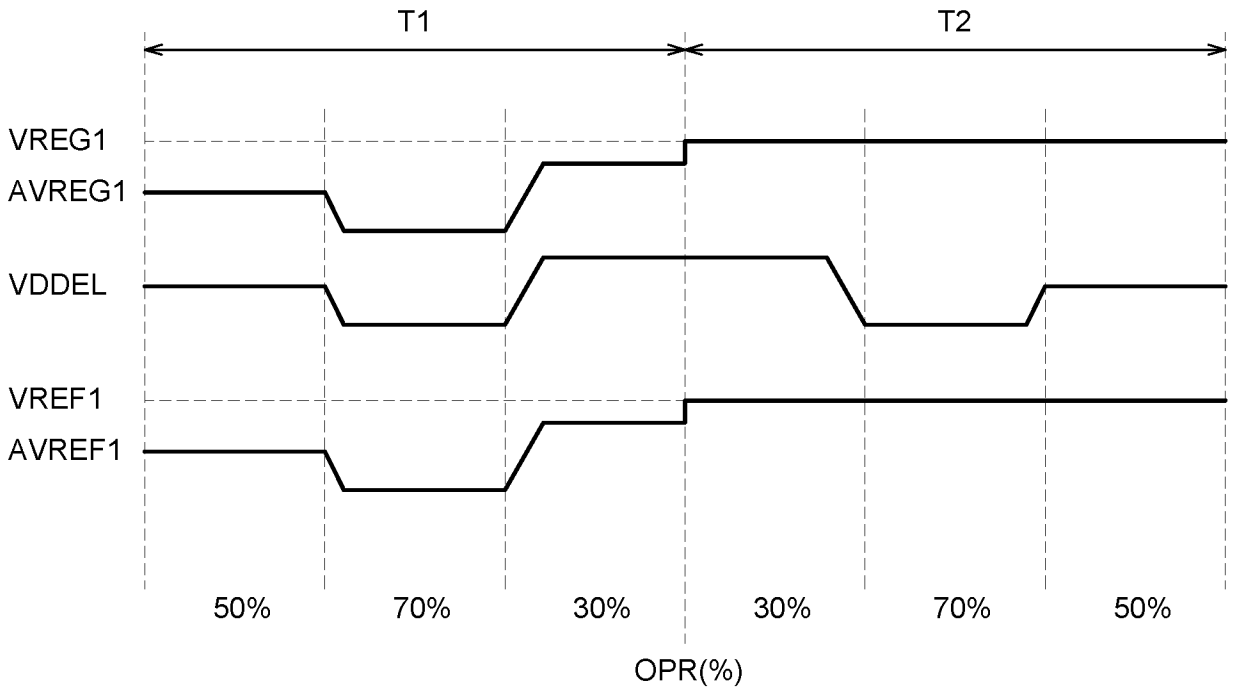
FIG. 4 is a waveform of a gamma unit of a display device according to an exemplary embodiment of the present disclosure.

Next, FIG. 4 is a waveform of a gamma unit of a display device according to an exemplary embodiment of the present disclosure. Referring to FIG. 4, when the first gamma reference voltage V1 is used, a waveform as in a second period T2 may be identified. When an on pixel ratio (OPR) is changed, that is, an image to be displayed is changed, the high potential power voltage VDDEL varies. However, the first gamma reference voltage V1 generated based on the first external power AVDDH can be maintained to be a constant voltage. Further, the on pixel ratio (OPR) indicates a ratio of turned-on pixels among the entire pixels, which will be described below in more detail with reference to FIG. 5A to 5C.

Referring to FIG. 3, the second gamma reference voltage generator 152 generates a second gamma reference voltage V2 based on a second external power VCIR and the feedback voltage VDDEL' of the high potential power voltage VDDEL. The second gamma reference voltage V2 includes a second upper gamma reference voltage AVREG1 and a second lower gamma reference voltage AVREF1.

The feedback voltage VDDEL' of the high potential power voltage VDDEL is a feedback voltage VDDEL' for the high potential power voltage VDDEL applied to the display panel 110. The high potential power voltage VDDEL supplied to the display panel 110 may vary due to the voltage drop and the varied high potential power voltage VDDEL may be supplied to the gamma unit 150 as a feedback voltage VDDEL'. Therefore, the second gamma reference voltage generator 152 reflects the voltage drop of the high potential power voltage VDDEL to generate a second gamma reference voltage V2. Accordingly, the second gamma reference voltage V2 generated in consideration of the feedback voltage VDDEL' of the high potential power voltage VDDEL can vary similar to the high potential power voltage VDDEL and a gap from the high potential power voltage VDDEL can be constantly maintained. For example, as an amount of changed feedback voltage VDDEL' is increased, an amount of changed second gamma reference voltage V2 can also be increased.

When the second gamma reference voltage V2 is used, the gamma voltage VG and the data voltage Vdata generated by the second gamma reference voltage V2 can be also coupled to the high potential power voltage VDDEL. Thus, the luminance variation in accordance with the voltage drop of the high potential power voltage VDDEL can be minimized. Specifically, as represented in Equation 1, the driving current $I_{oled}$ can be determined by the high potential power voltage VDDEL and the data voltage Vdata. However, even though the high potential power voltage VDDEL varies in accordance with the voltage drop of the high potential power voltage VDDEL, the second gamma reference voltage V2 and the data voltage Vdata generated by the second gamma reference voltage V2 are coupled to the high potential power voltage VDDEL. Therefore, the variation of the driving current $I_{oled}$ caused by the variation of the high potential power voltage VDDEL can be minimized. Accordingly, the second gamma reference voltage V2 is used to minimize the variation of the luminance caused by the voltage drop of the high potential power voltage VDDEL.

For example, referring to FIG. 4, when the second gamma reference voltage V2 is used, a waveform as in a first period T1 can be identified. As the on pixel ratio and the image to be displayed are changed, the high potential power voltage VDDEL is changed and the second gamma reference voltage V2 generated based on the feedback voltage VDDEL' of the high potential power voltage VDDEL can vary similar to the high potential power voltage VDDEL.

Further, the first external power VDDH and the second external power VCIR supplied to the first gamma reference voltage generator 151 and the second gamma reference voltage generator 152, respectively, can be supplied from the power supply unit 140 or supplied from another configuration at the outside of the display device 100, but it is not limited thereto.

Referring to FIG. 3 again, the gamma voltage generator 155 can generate a plurality of gamma voltages VG based on the first gamma reference voltage V1 from the first gamma reference voltage generator 151 or the second gamma reference voltage V2 from the second gamma reference voltage generator 152. For example, the gamma voltage generator 155 divides voltages between the first upper gamma reference voltage VREG1 and the first lower gamma reference voltage VREF1 to generate a plurality of gamma voltages VG corresponding to each of all individual gray scales. Further, the gamma voltage generator 155 divides voltages between the second upper gamma reference voltage AVREG1 and the second lower gamma reference voltage AVREF1 to generate a plurality of gamma voltages VG corresponding to each of all individual gray scales.

The voltage setting unit 153 selectively connects one of the first gamma reference voltage generator 151 and the second gamma reference voltage generator 152 to the gamma voltage generator 155. The voltage setting unit 153 is connected between the first gamma reference voltage generator 151 and the gamma voltage generator 155 and between the second gamma reference voltage generator 152 and the gamma voltage generator 155 to connect only any one of the first gamma reference voltage generator 151 and the second gamma reference voltage generator 152 to the gamma voltage generator 155. For example, the voltage setting unit 153 may be configured to include switches connected between each of the first gamma reference voltage generator 151 and the gamma voltage generator 155 and between the second gamma reference voltage generator 152 and the gamma voltage generator 155, but is not limited thereto.

The output unit 154 outputs the first gamma reference voltage V1 from the first gamma reference voltage generator 151 or the second gamma reference voltage V2 from the second gamma reference voltage generator 152 to the gamma voltage generator 155. The output unit 154 is connected between the voltage setting unit 153 and the gamma voltage generator 155. When the first gamma reference voltage generator 151 and the second gamma reference voltage generator 152 are switched, the output unit 154 gradually changes and outputs the first gamma reference voltage V1 and the second gamma reference voltage V2. For example, when the voltage setting unit 153 disconnects the first gamma reference voltage generator 151 from the gamma voltage generator 155, and connects the second gamma reference voltage generator 152 to the gamma voltage generator 155, the output unit 154 gradually changes an initial second gamma voltage VG for N frames to output the second gamma reference voltage V2.

Further, the voltage setting unit 153 selectively connects one of the first gamma reference voltage generator 151 and the second gamma reference voltage generator 152 to the gamma voltage generator 155 in accordance with the on pixel ratio (OPR).

Figure 5A:
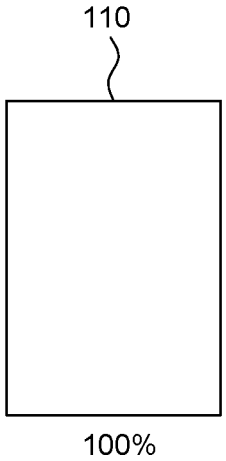
FIG. 5A to 5C are a schematic plan view of a display device for explaining an on pixel ratio.
Figure 5B:
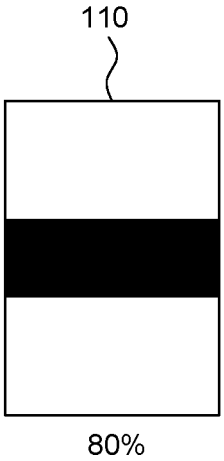
Figure 5C:
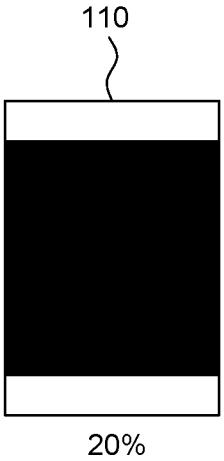

In particular, FIG. 5A to 5C are a schematic plan view of a display device for explaining an on pixel ratio. Referring to FIGS. 5A to 5C, the on pixel ratio is a ratio representing a ratio of pixels which are turned on to emit white light, among the plurality of pixels. For example, as illustrated in FIG. 5A, when all the plurality of pixels is turned on to emit white light, the on pixel ratio may be 100%. Further, as illustrated in FIGS. 5B and 5C, when only some pixels are turned on to emit white light, the on pixel ratios may be 80% and 20%.

Figure 6A:
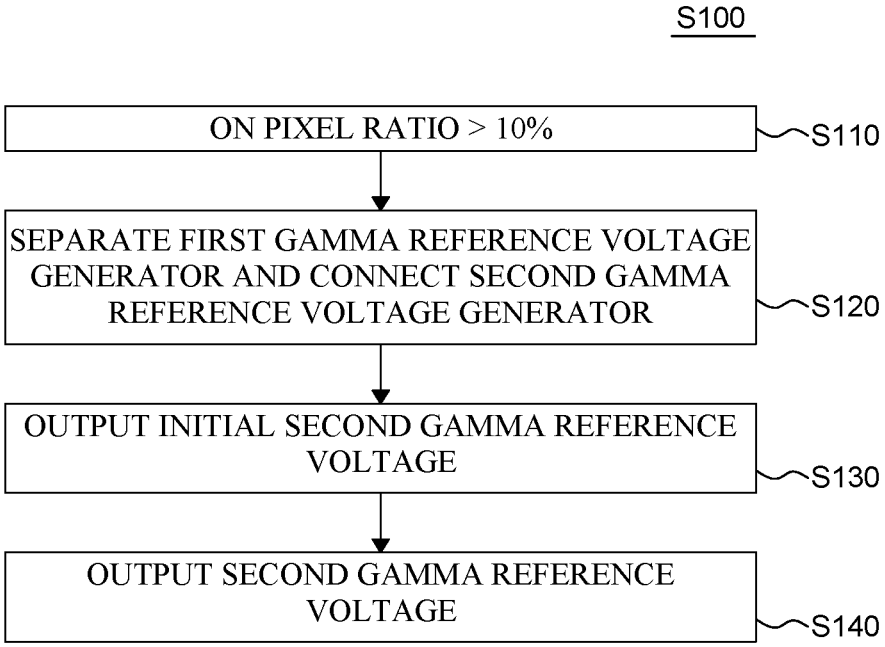
FIG. 6A is a flowchart and FIG. 6B is a block diagram illustrating an operation of a gamma unit when an on pixel ratio is higher than a reference pixel ratio.
Figure 6B:
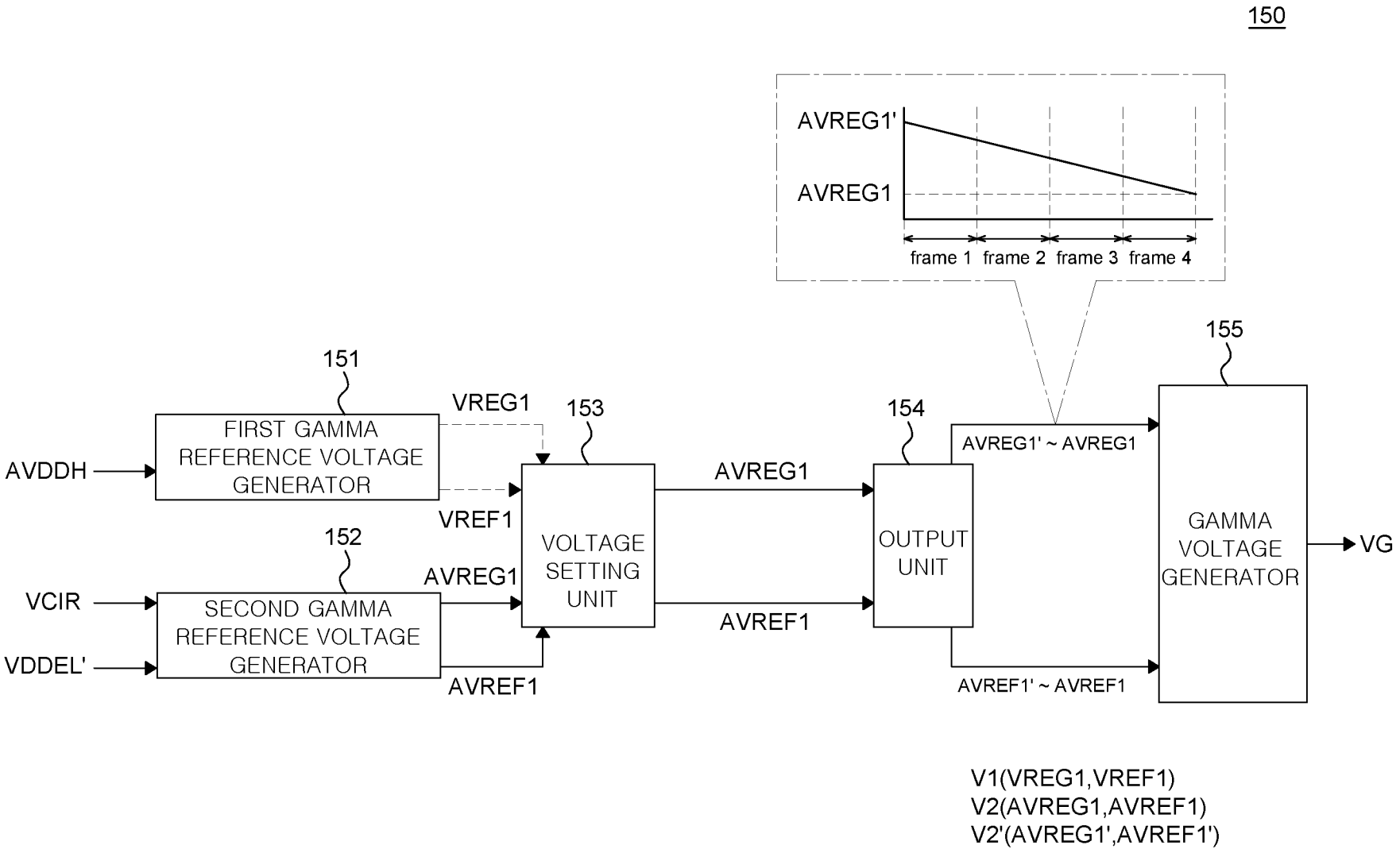
Figure 7A:
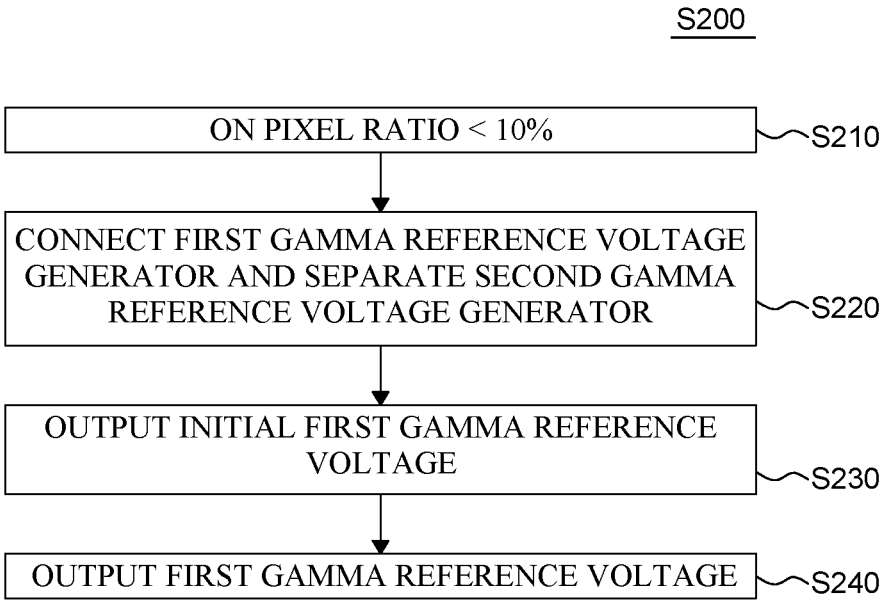
FIG. 7A is a flowchart and FIG. 7B is a block diagram illustrating an operation of a gamma unit when an on pixel ratio is lower than a reference pixel ratio.
Figure 7B:
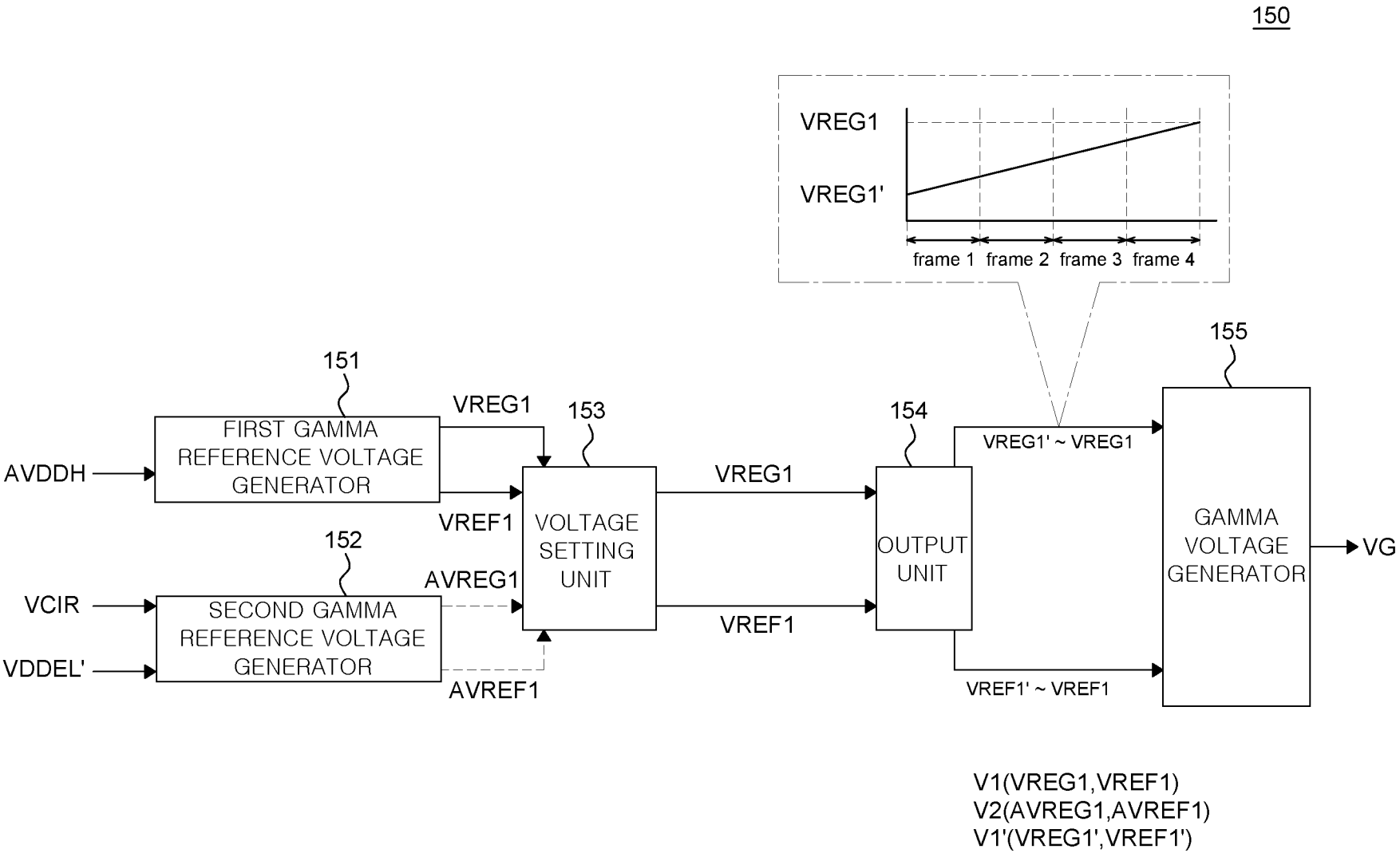

Hereinafter, a process of generating a gamma voltage VG according to the on pixel ratio will be described with reference to FIGS. 6A to 7B. In particular, FIG. 6A is a flowchart and FIG. 6B is a block diagram illustrating an operation of a gamma unit when an on pixel ratio is higher than a reference pixel ratio. Also, FIG. 7A is a flowchart and FIG. 7B is a block diagram illustrating an operation of a gamma unit when an on pixel ratio is lower than a reference pixel ratio.

Specifically, FIG. 6A is a flowchart illustrating a process of generating a gamma voltage VG using a second gamma reference voltage V2 in the display device 100 according to the exemplary embodiment of the present disclosure, and FIG. 6B is a diagram of the gamma unit 150 of the display device 100 according to an exemplary embodiment of the present disclosure.

Referring to FIGS. 6A and 6B, when the on pixel ratio is higher than a reference pixel ratio (S110), the voltage setting unit 153 disconnects the first gamma reference voltage generator 151 from the gamma voltage generator 155, and connects the second gamma reference voltage generator 152 to the gamma voltage generator 155 (S120). For example, when the on pixel ratio is higher than 10%, the voltage setting unit 153 connects the second gamma reference voltage generator 152 to the gamma voltage generator 155.

When the first gamma reference voltage generator 151 and the second gamma reference voltage generator 152 are switched, screen flickering may be generated due to the difference of the first gamma reference voltage V1 and the second gamma reference voltage V2. In particular, the first gamma reference voltage V1 is generated based on the first external power AVDDH and the second gamma reference voltage V2 is generated based on the feedback voltage VDDEL' of the high potential power voltage VDDEL. Therefore, even in the same image, the first gamma reference voltage V1 and the second gamma reference voltage V2 may be different. Further, the target luminance corresponding to each of the first gamma reference voltage V1 and the second gamma reference voltage V2 may be different.

For example, referring to FIG. 4, when an interval in which the on pixel ratio is 30% in a second period T2 in which the first gamma reference voltage V1 is used and an interval in which the on pixel ratio is 30% in a first period T1 in which the second gamma reference voltage V2 is used are compared, it may be confirmed that even in the same on pixel ratio which is 30%, the first gamma reference voltage V1 and the second gamma reference voltage V2 are different. Further, since the first gamma reference voltage V1 and the second gamma reference voltage V2 are different, the data voltages Vdata generated based on the first gamma reference voltage V1 and the second gamma reference voltage V2 and the luminance of the displayed images are also different.

Accordingly, when the gamma reference voltage supplied to the gamma voltage generator 155 is changed from the first gamma reference voltage V1 to the second gamma reference voltage V2 or changed from the second gamma reference voltage V2 to the first gamma reference voltage V1, the screen flickering may be generated due to the sudden change of the voltage and the target luminance. Therefore, when the first gamma reference voltage V1 and the second gamma reference voltage V2 are switched from each other, the output unit 154 gradually changes the gamma reference voltage to supply the gamma reference voltage to the gamma voltage generator 155.

Specifically, referring to FIG. 6B, when the voltage setting unit 153 disconnects the first gamma reference voltage generator 151 from the gamma voltage generator 155 and connects the second gamma reference voltage generator 152 to the gamma voltage generator 155, the output unit 154 outputs an initial second gamma reference voltage V2' (S130). The initial second gamma reference voltage V2' includes an initial second upper gamma reference voltage AVREG1' and an initial second lower gamma reference voltage AVREF1'. The initial second gamma reference voltage V2' has the same target luminance as the first gamma reference voltage V1 and the initial second gamma reference voltage V2' and the first gamma reference voltage V1 may display images with the same luminance. In this instance, the display device 100 is tested in advance to detect the initial second gamma reference voltage V2' which implements an image having the same luminance as an image displayed on the display panel 110, in accordance with the first gamma reference voltage V1.

Next, the output unit 154 gradually increases or decreases the initial second gamma reference voltage V2' for N frames to output a second gamma reference voltage V2 (S140). In the first frame after connecting the second gamma reference voltage generator 152 and the gamma voltage generator 155, the output unit 154 converts the second gamma reference voltage V2 supplied from the second gamma reference voltage generator 152 to output the initial second gamma reference voltage V2'. Next, in a subsequent frame, the output unit 154 gradually increases or decreases the initial second gamma reference voltage V2' so as to be close to the second gamma reference voltage V2 to output the initial second gamma reference voltage V2'. In an N-th frame, for example, a fourth frame, the second gamma reference voltage V2 can be finally output. Accordingly, the output unit 154 gradually outputs the initial second gamma reference voltage V2' to the second gamma reference voltage V2 to the gamma voltage generator 155 during the N-th frame.

For example, referring to FIG. 6B, for the second upper gamma reference voltage AVREG1 of the second gamma reference voltage V2, in the first frame, the initial second upper gamma reference voltage AVREG1' can be output to the gamma voltage generator 155. The initial second upper gamma reference voltage AVREG1' is gradually increased or decreased during the N-th frame to finally output the second upper gamma reference voltage AVREG1 to the gamma voltage generator 155.

Further, the second lower gamma reference voltage AVREF1 of the second gamma reference voltage V2 can be also output to the gamma voltage generator 155 by the same manner as the second upper gamma reference voltage AVREG1. For example, in the first frame in which the second gamma reference voltage generator 152 is connected, the initial second lower gamma reference voltage AVREF1' is output to the gamma voltage generator 155. During the N-th frame, the initial second gamma reference voltage AVREF1' is gradually increased or decreased to finally output the second lower gamma reference voltage AVREF1 to the gamma voltage generator 155.

Further, even though FIG. 6B illustrates the N-th frame is the fourth frame, the number of frames in which the initial second gamma reference voltage V2' is gradually changed to output the second gamma reference voltage V2 is not limited thereto. In addition, the output unit 154 can be configured by an element, such as a regulator, to gradually vary and output the second gamma reference voltage V2 from the second gamma reference voltage generator 152, but it is not limited thereto.

Next, FIG. 7A is a flowchart illustrating a process of generating a gamma voltage VG using a first gamma reference voltage V1 in the display device 100 according to the exemplary embodiment of the present disclosure. FIG. 7B is a diagram of the gamma unit 150 of the display device 100 according to an exemplary embodiment of the present disclosure.

Referring to FIGS. 7A and 7B, when the on pixel ratio is lower than a reference pixel ratio (S210), the voltage setting unit 153 disconnects the second gamma reference voltage generator 152 from the gamma voltage generator 155, and connects the first gamma reference voltage generator 151 to the gamma voltage generator 155 (S220). For example, when the on pixel ratio is lower than 10%, the voltage setting unit 153 can connect the first gamma reference voltage generator 151 to the gamma voltage generator 155.

In addition, the first gamma reference voltage V1 is a voltage generated from the first external power AVDDH regardless of the high potential power voltage VDDEL. The gamma voltage VG and the data voltage Vdata generated using the first gamma reference voltage V1 are not affected by the variation of the high potential power voltage VDDEL. In this instance, the data voltage Vdata is not changed together with the high potential power voltage VDDEL so that the voltage difference of the data voltage Vdata based on the first gamma reference voltage V1 and the high potential power voltage VDDEL can be increased and the driving current $I_{oled}$ and the luminance can be also increased. In other words, the second gamma reference voltage V2 coupled to the high potential power voltage VDDEL minimizes the luminance change in accordance with the variance of the high potential power voltage VDDEL. In contrast, the first gamma reference voltage V1 which is not coupled to the high potential power voltage VDDEL can maximize the luminance change in accordance with the variance of the high potential power voltage VDDEL.

For the image having an on pixel ratio of 10% or lower in which the first gamma reference voltage V1 is used, most pixels are turned off NS are represented as being black. When the first gamma reference voltage V1 is used, as compared with using the second gamma reference voltage V2, the luminance of the turned-on pixel can be increased and a contrast of the turned-off pixel and the turned-on pixel, that is, a contrast of black and white, or a contrast ratio, can be increased. Therefore, when the on pixel ratio is lower than the reference pixel ratio, for example, the first gamma reference voltage V1 is used to maximize the luminance change and enhance the contrast of black and white.

When the voltage setting unit 153 disconnects the second gamma reference voltage generator 152 from the gamma voltage generator 155 and connects the first gamma reference voltage generator 151 and the gamma voltage generator 155, the output unit 154 outputs an initial first gamma reference voltage V1' (S230). The initial first gamma reference voltage V1' includes an initial first upper gamma reference voltage VREG1' and an initial first lower gamma reference voltage VREF1'. Further, the initial first gamma reference voltage V1' is a voltage value which displays an image with the same luminance as the second gamma reference voltage V2. In this instance, the display device 100 is tested in advance to detect the initial first gamma reference voltage V1' which implements an image having the same luminance as an image displayed on the display panel 110, in accordance with the second gamma reference voltage V2.

Next, the output unit 154 gradually changes the initial first gamma reference voltage V1' during N frames to output a first gamma reference voltage V1 (S240). For example, in the first frame after connecting the first gamma reference voltage generator 151 and the gamma voltage generator 155, the output unit 154 converts the first gamma reference voltage V1 supplied from the first gamma reference voltage generator 151 to output the initial first gamma reference voltage V1'. Next, in a subsequent frame, the output unit 154 gradually converts the first gamma reference voltage V1' so as to be close to the first gamma reference voltage V1 to output the initial first gamma reference voltage V1'. Finally, the N-th frame, for example, in the fourth frame, the first gamma reference voltage V1 can be finally output. Accordingly, the output unit 154 can gradually output the initial first gamma reference voltage V1' to the first gamma reference voltage V1 to the gamma voltage generator 155 during the N-th frame.

For example, referring to FIG. 7B, for the first upper gamma reference voltage VREG1 of the first gamma reference voltage V1, in the first frame, the initial first upper gamma reference voltage VREG1' can be output to the gamma voltage generator 155. The initial first upper gamma reference voltage VREG1' is gradually increased or decreased during the N-th frame to finally output the first upper gamma reference voltage VREG1 to the gamma voltage generator 155.

In addition, the first lower gamma reference voltage VREF1 of the first gamma reference voltage V1 can be also output to the gamma voltage generator 155 in the same manner as the first upper gamma reference voltage VREG1. For example, in the first frame in which the first gamma reference voltage generator 151 is connected, the initial first lower gamma reference voltage VREF1' is output to the gamma voltage generator 155. During the N-th frame, the initial first lower gamma reference voltage VREF1' is gradually increased or decreased to finally output the first lower gamma reference voltage VREF1 to the gamma voltage generator 155.

Further, the output unit 154 modifies the first gamma reference voltage V1 to output the initial first gamma reference voltage V1' to the first gamma reference voltage V1 and modifies the second gamma reference voltage V2 to output the initial second gamma reference voltage V2' to the second gamma reference voltage V2. However, the voltage setting unit 153 can output the initial first gamma reference voltage V1' to the first gamma reference voltage V1 and output the initial second gamma reference voltage V2' to the second gamma reference voltage V2, but it is not limited thereto.

Accordingly, in the display device 100 according to the exemplary embodiment of the present disclosure, the first gamma reference voltage V1 or the second gamma reference voltage V2 is selected to be used depending on the displayed image. The first gamma reference voltage V1 is a voltage generated based on the first external power AVDDH to have a constant value regardless of the variation of the high potential power voltage VDDEL. When the sub pixel SP includes the first to sixth transistors T6 and the driving transistor DT, the driving current $I_{oled}$ flowing in the light emitting element EL can be determined by the data voltage Vdata and the high potential power voltage VDDEL. Therefore, when the first gamma reference voltage V1 is used, the voltage difference of the data voltage Vdata based on the first gamma reference voltage V1 and the high potential power voltage VDDEL can be increased more and maximize the luminance change. Accordingly, in an image having a low on pixel ratio, the first gamma reference voltage V1 is used to enhance the contrast of black and white. Also, the second gamma reference voltage V2 is generated based on the feedback voltage VDDEL' of the high potential power voltage VDDEL and the data voltage Vdata generated thereby can vary in the same manner as the high potential power voltage VDDEL. Accordingly, the second gamma reference voltage V2 is used for an image having a high on pixel ratio to minimize the luminance degradation caused by the voltage drop of the high potential power voltage VDDEL. Accordingly, in the display device 100 according to the exemplary embodiment of the present disclosure, the first gamma reference voltage V1 and the second gamma reference voltage V2 are selectively used according to the characteristic of the image to improve a quality of the displayed image.

In the display device 100 according to the exemplary embodiment of the present disclosure, the gamma reference voltage supplied to the gamma voltage generator 155 is gradually changed to minimize the screen flickering according to the sudden voltage variation. When the first gamma reference voltage V1 and the second gamma reference voltage V2 are varied and used, in the image having a low on pixel ratio, the contrast of black and white may be enhanced and in the image having a high on pixel ratio, the luminance degradation according to the voltage drop of the high potential power voltage VDDEL may be minimized. However, even in the environment having the same on pixel ratio, the first gamma reference voltage V1 is based on the first external power AVDDH and the second gamma reference voltage V2 is based on the feedback voltage VDDEL' of the high potential power voltage VDDEL so that there may be a difference in voltage and luminance. In this instance, when the first gamma reference voltage V1 and the second gamma reference voltage V2 are directly switched from each other, the voltage and the target luminance are sharply changed to cause the screen flickering. Accordingly, when the first gamma reference voltage V1 is switched to the second gamma reference voltage V2, an initial second gamma reference voltage V2' implementing a luminance corresponding to the first gamma reference voltage V1 is supplied to the gamma voltage generator 155. Further, the initial second gamma reference voltage V2' can gradually vary during the N-th frame. Therefore, finally, in the N-th frame, the second gamma reference voltage V2 can be supplied to the gamma voltage generator 155 and an error caused by the sudden voltage change may be minimized. Further, when the second gamma reference voltage V2 is switched to the first gamma reference voltage V1, an initial first gamma reference voltage V1' which implements a luminance corresponding to the second gamma reference voltage V2 is supplied to the gamma voltage generator 155. Further, the initial first gamma reference voltage V1' can gradually vary during the N-th frame. Therefore, finally, in the N-th frame, the first gamma reference voltage V1 is supplied to the gamma voltage generator 155 and an error caused by the sudden voltage change can be minimized. Accordingly, in the display device 100 according to the exemplary embodiment of the present disclosure, when the first gamma reference voltage V1 and the second gamma reference voltage V2 are switched from each other, the gamma reference voltage output to the gamma voltage generator 155 gradually varies. As a result, the flickering due to the sudden voltage and target luminance change can be minimized.

The exemplary embodiments of the present disclosure can also be described as follows. According to an aspect of the present disclosure, there is provided a display device including a gamma unit including a gamma reference voltage generator which generates a plurality of gamma reference voltages and a gamma voltage generator which generates a gamma voltage based on the gamma reference voltages, a data driver which generates a data voltage based on the gamma voltage, and a display panel which is electrically connected to the data driver. The gamma reference voltage generator includes a first gamma reference voltage generator which generates a first gamma reference voltage, among the plurality of gamma reference voltages, based on an external power, and a second gamma reference voltage generator which generates a second gamma reference voltage, among the plurality of gamma reference voltages, based on a feedback voltage of a high potential power voltage from the display panel.

The display panel includes a plurality of pixels, and when an on pixel ratio (OPR) representing a ratio of turned on pixels among the plurality of pixels is lower than a reference pixel ratio, the first gamma reference voltage can be output from the first gamma reference voltage generator to the gamma voltage generator. When the on pixel ratio is higher than the reference pixel ratio, the second gamma reference voltage can be output from the second gamma reference voltage generator to the gamma voltage generator.

The gamma unit further includes a voltage setting unit which selectively connects one of the first gamma reference voltage generator and the second gamma reference voltage generator to the gamma voltage generator, and an output unit between the voltage setting unit and the gamma voltage generator, and configured to gradually vary the first gamma reference voltage or the second gamma reference voltage output to the gamma voltage generator.

When the second gamma reference voltage generator is disconnected from the gamma voltage generator by the voltage setting unit and the first gamma reference voltage generator is connected to the gamma voltage generator, the output unit can output an initial first gamma reference voltage corresponding to the second gamma reference voltage in an initial frame and gradually vary the initial first gamma reference voltage during an N-th frame to output the first gamma reference voltage.

When the first gamma reference voltage generator is disconnected from the gamma voltage generator by the voltage setting unit and the second gamma reference voltage generator is connected to the gamma voltage generator, the output unit can output an initial second gamma reference voltage corresponding to the first gamma reference voltage in an initial frame and gradually vary the initial second gamma reference voltage during an N-th frame to output the second gamma reference voltage.

When an amount of changed feedback voltage is increased, an amount of changed second gamma reference voltage can be increased. Also, when an amount of changed feedback voltage is increased, the first gamma reference voltage can be constant.

According to another aspect of the present disclosure, there is provided a display device including a gamma unit including a first gamma reference voltage generator which generates a first gamma reference voltage, a second gamma reference voltage generator which generates a second gamma reference voltage, and a gamma voltage generator which generates a gamma voltage based on the first gamma reference voltage or the second gamma reference voltage, a data driver which generates a data voltage based on the gamma voltage, and a display panel which includes a plurality of pixels which is driven by a high potential power voltage and the data voltage. When an on pixel ratio representing a ratio of turned on pixels among the plurality of pixels is lower than a reference pixel ratio, the gamma reference voltage generator generates the gamma voltage based on the first gamma reference voltage and when the on pixel ratio is higher than the reference pixel ratio, the gamma voltage generator generates the gamma voltage based on the second gamma reference voltage.

In addition, the first gamma reference voltage generator can generate the first gamma reference voltage having a constant value based on an external power, and the second gamma reference voltage can be coupled to a feedback voltage of the high potential power voltage from the display panel.

The gamma unit further includes a voltage setting unit connected between the first gamma reference voltage generator and the gamma voltage generator and between the second gamma reference voltage generator and the gamma voltage generator, and an output unit connected between the voltage setting unit and the gamma voltage generator, and the voltage setting unit can connect any one of the first gamma reference voltage generator and the second gamma reference voltage generator to the output unit and the gamma voltage generator.

When the voltage setting unit disconnects the second gamma reference voltage generator from the output unit and connects the first gamma reference voltage generator to the output unit, the output unit can gradually vary an initial first gamma reference voltage in the unit of frames to transmit the first gamma reference voltage to the gamma voltage generator after an N-th frame, and an image displayed on the display panel based on the initial first gamma reference voltage and an image displayed on the display panel based on the second gamma reference voltage can have the same luminance.

When the voltage setting unit disconnects the first gamma reference voltage generator from the output unit and connects the second gamma reference voltage generator to the output unit, the output unit can gradually vary an initial second gamma reference voltage in the unit of frames to transmit the second gamma reference voltage to the gamma voltage generator after an N-th frame, and an image displayed on the display panel based on the initial second gamma reference voltage and an image displayed on the display panel based on the first gamma reference voltage can have the same luminance.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gamma unit for a display panel, the gamma unit comprising:

a first gamma reference voltage generator configured to generate a first gamma reference voltage;

a second gamma reference voltage generator configured to generate a second gamma reference voltage;

a gamma voltage generator configured to output a first gamma voltage based on the first gamma reference voltage or output a second gam ma voltage based on the second gamma reference voltage; and a voltage setting unit disposed between the first and second gamma reference voltage generators and the gamma voltage generator and configured to selectively connect the first gamma reference voltage generator to the gamma voltage generator to output the first gamma voltage or selectively connect the second gamma reference voltage generator to the gamma voltage generator to output the second gamma voltage, wherein the second gamma reference voltage is coupled to a feedback voltage of a high potential power voltage from the display panel, and wherein the voltage setting unit is configured to:

selectively connect the first gamma reference voltage generator or the second gamma reference voltage generator to the gamma voltage generator based on comparing an on pixel ratio representing a ratio of turned on pixels among a plurality of pixels with a reference pixel ratio.

2. The gamma unit according to claim 1, wherein the voltage setting unit is configured to:

selectively connect the first gamma reference voltage generator to the gamma voltage generator to output the first gamma voltage when the on pixel ratio representing the ratio of turned on pixels among the plurality of pixels is lower than the reference pixel ratio.

3. The gamma unit according to claim 2, wherein the voltage setting unit is configured to:

selectively connect the second gamma reference voltage generator to the gamma voltage generator to output the second gamma voltage when the on pixel ratio is higher than the reference pixel ratio.

4. The gamma unit according to claim 2, wherein the gamma unit further includes:

an output unit disposed between the voltage setting unit and the gamma voltage generator and configured to gradually vary the first gamma reference voltage or the second gamma reference voltage output to the gamma voltage generator.

5. The gamma unit according to claim 4, wherein the output unit is further configured to:

output an initial first gamma reference voltage corresponding to the second gamma reference voltage in an initial frame and gradually vary the initial first gamma reference voltage during an N-th frame to output the first gamma reference voltage when the voltage setting unit disconnects the second gamma reference voltage generator from the gamma voltage generator and connects the first gamma reference voltage generator to the gamma voltage generator, and wherein an image displayed on the display panel based on the initial first gamma reference voltage and an image displayed on the display panel based on the second gamma reference voltage have a same luminance.

6. The gamma unit according to claim 5, wherein the output unit is further configured to:

output an initial second gamma reference voltage corresponding to the first gamma reference voltage in an initial frame and gradually vary the initial second gamma reference voltage during an N-th frame to output the second gamma reference voltage when the voltage setting unit disconnects the first gamma reference voltage generator from the gamma voltage generator and connects the second gamma reference voltage generator to the gamma voltage generator, and wherein an image displayed on the display panel based on the initial second gamma reference voltage and an image displayed on the display panel based on the first gamma reference voltage have a same luminance.

7. The gamma unit according to claim 1, wherein the first gamma reference voltage generator is supplied with a first external power, and wherein the second gamma reference voltage generator is supplied with a second external power and is coupled to the feedback voltage of the high potential power voltage from the display panel.

8. The gamma unit according to claim 7, wherein the second gamma reference voltage generator is configured to increase the second gamma reference voltage in correspondence to an increase in the feedback voltage, and wherein the first gamma reference voltage generator is configured to maintain the first gamma reference voltage constant when the feedback voltage is increased.

9. A display device, comprising:

a display panel including a plurality of pixels and supplied with a high potential power voltage;

a gamma unit including:

a first gamma reference voltage generator configured to generate a first gamma reference voltage;

a second gamma reference voltage generator configured to generate a second gamma reference voltage;

a gamma voltage generator configured to output a first gamma voltage based on the first gamma reference voltage or output a second gamma voltage based on the second gamma reference voltage; and a voltage setting unit disposed between the first and second gamma reference voltage generators and the gamma voltage generator and configured to selectively connect the first gamma reference voltage generator to the gamma voltage generator to output the first gamma voltage or selectively connect the second gamma reference voltage generator to the gamma voltage generator to output the second gamma voltage; and a data driver configured to apply a data voltage to the display panel based on the gamma voltage output by the gamma voltage generator, wherein the second gamma reference voltage is coupled to a feedback voltage of the high potential power voltage from the display panel, and wherein the voltage setting unit is configured to:

selectively connect the first gamma reference voltage generator or the second gamma reference voltage generator to the gamma voltage generator based on comparing an on pixel ratio representing a ratio of turned on pixels among the plurality of pixels with a reference pixel ratio.

10. The display device according to claim 9, wherein the voltage setting unit is configured to:

selectively connect the first gamma reference voltage generator to the gamma voltage generator to output the first gamma voltage when the on pixel ratio representing the ratio of turned on pixels among the plurality of pixels is lower than the reference pixel ratio.

11. The display device according to claim 10, wherein the voltage setting unit is configured to:

selectively connect the second gamma reference voltage generator to the gamma voltage generator to output the second gamma voltage when the on pixel ratio is higher than the reference pixel ratio.

12. The display device according to claim 9, wherein the gamma unit further includes:

an output unit disposed between the voltage setting unit and the gamma voltage generator and configured to gradually vary the first gamma reference voltage or the second gamma reference voltage output to the gamma voltage generator.

13. The display device according to claim 12, wherein the output unit is further configured to:

output an initial first gamma reference voltage corresponding to the second gamma reference voltage in an initial frame and gradually vary the initial first gamma reference voltage during an N-th frame to output the first gamma reference voltage when the voltage setting unit disconnects the second gamma reference voltage generator from the gamma voltage generator and connects the first gamma reference voltage generator to the gamma voltage generator.

14. The display device according to claim 13, wherein an image displayed on the display panel based on the initial first gamma reference voltage and an image displayed on the display panel based on the second gamma reference voltage have a same luminance.

15. The display device according to claim 13, wherein the output unit is further configured to:

output an initial second gamma reference voltage corresponding to the first gamma reference voltage in an initial frame and gradually vary the initial second gamma reference voltage during an N-th frame to output the second gamma reference voltage when the voltage setting unit disconnects the first gamma reference voltage generator from the gamma voltage generator and connects the second gamma reference voltage generator to the gamma voltage generator.

16. The display device according to claim 15, wherein an image displayed on the display panel based on the initial second gamma reference voltage and an image displayed on the display panel based on the first gamma reference voltage have a same luminance.

17. The display device according to claim 9, wherein the first gamma reference voltage generator is supplied with a first external power.

18. The display device according to claim 17, wherein the second gamma reference voltage generator is supplied with a second external power and is coupled to the feedback voltage of the high potential power voltage from the display panel.

19. The display device according to claim 18, wherein the second gamma reference voltage generator is configured to increase the second gamma reference voltage in correspondence to an increase in the feedback voltage.

20. The display device according to claim 19, wherein the first gamma reference voltage generator is configured to maintain the first gamma reference voltage constant when the feedback voltage is increased.

* * * * *